US007051796B2

(12) United States Patent
Kamiyama et al.

(10) Patent No.: US 7,051,796 B2
(45) Date of Patent: May 30, 2006

(54) HEAT EXCHANGER

(75) Inventors: Naohisa Kamiyama, Ashikaga (JP); Katsumi Uehara, Ota (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/847,255

(22) Filed: May 17, 2004

(65) Prior Publication Data

US 2005/0006070 A1 Jan. 13, 2005

(30) Foreign Application Priority Data

May 20, 2003 (JP) ..... P2003-141845

(51) Int. Cl.
*F28F 9/02* (2006.01)

(52) U.S. Cl. ..... 165/140; 165/174

(58) Field of Classification Search ..... 165/140, 165/144, 151–153, 173, 174, 176
See application file for complete search history.

(56) References Cited

U.S. PATENT DOCUMENTS 4,341,346 A * 7/1982 Simpson ..... 165/173
5,203,407 A * 4/1993 Nagasaka ..... 165/174
6,125,927 A * 10/2000 Hubert ..... 165/173
6,736,201 B1 * 5/2004 Watton et al. ..... 165/166
6,814,136 B1 * 11/2004 Yi et al. ..... 165/153
6,827,139 B1 * 12/2004 Kawakubo et al. ..... 165/173
2004/0159121 A1 * 8/2004 Horiuchi et al. ..... 165/153
2005/0039901 A1 * 2/2005 Demuth et al. ..... 165/175

FOREIGN PATENT DOCUMENTS

JP 63-91488 * 4/1988
JP 5-346297 * 12/1993
JP 09-166368 6/1997
JP 11-337293 * 12/1999

* cited by examiner

*Primary Examiner*—Teresa J. Walberg
(74) *Attorney, Agent, or Firm*—Kilpatrick Stockton LLP

(57) ABSTRACT

A heat exchanger includes a core. The core includes a heat-exchange tube for a heat exchange medium to circulate therein. The core includes a fin joined to the heat-exchange tube. The heat exchanger includes a pair of header pipes connected with both ends of the core. Each of header pipes includes header pipe members. Each of header pipes has a joint member communicating with header pipe members. The joint member has communication holes arranged longitudinally of the header pipes at intervals.

8 Claims, 9 Drawing Sheets

HEAT EXCHANGER

CROSS-REFERENCE TO RELATED APPLICATIONS

This application is based upon and claims the benefit of priority from Japanese Patent Application No. 2003-141845 filed on May 20, 2003; the entire contents of which are incorporated herein by reference.

BACKGROUND OF THE INVENTION

The present invention relates to a heat exchanger mounted on a vehicle such as an automobile. The heat exchanger includes, for example, a radiator for cooling an engine, an air-conditioning condenser, an oil cooler (ATF cooler) for cooling oil of automatic transmission, and an oil cooler for cooling an engine oil.

An automobile includes various heat exchangers. The heat exchangers include heat-exchange tubes through which medium flows, and header pipes connected to the heat-exchange tubes. Each of the header pipes includes communication holes in communication with the heat-exchange tubes. The communication holes become greater in diameter, as a header pipe extends upstream of the medium in the flowing direction. The communication holes become smaller in diameter, as the header pipe extends downstream of the medium. This arrangement uniformly distributes the medium, which flows from the header pipe to the heat-exchange tube (For example, Japanese Patent Application Laid-open No. H9-166368).

SUMMARY OF THE INVENTION

In the heat exchangers, however, when the refrigerant passes through the communication holes, flowing resistance becomes greater. The heat exchanger requires a thick header pipe to maintain withstanding pressure (destroy-resistance strength). This structure increases the weight and cost of the heat exchangers.

The present invention provides a heat exchanger that uniformly distributes medium, which flows from a header pipe having great strength to a heat exchanging tube.

The invention has a first aspect directed to the following heat exchanger. The heat exchanger includes a core. The core includes a heat-exchange tube for a heat exchange medium to circulate therein. The core includes a fin joined to the heat-exchange tube. The heat exchanger includes a pair of header pipes connected with both ends of the core. Each of header pipes includes header pipe members. Each of header pipes has a joint member communicating with header pipe members. The joint member has communication holes arranged longitudinally of the header pipes at intervals.

The communication holes have hole sizes greater at upstream side of flow of the heat-exchange medium in the header pipe members. The hole sizes are smaller, as the communication holes are closer to downstream side of the heat exchange medium.

The communication holes have hole pitches therebetween smaller at upstream side of the heat-exchange medium flowing in the header pipe member. The hole pitches are greater, as the communication holes are closer to downstream side of the heat exchange medium.

Joint members are located longitudinally of the header pipe. The joint members have a regulation member therebetween configured to regulate the heat exchange medium.

The invention has a second aspect directed to the following heat exchanger. The heat exchanger includes a tube having a fluid therein for exchanging heat between the fluid and airflow during running of a vehicle. The heat exchanger includes a header pipe in communication with the tube for the fluid. The header pipe includes a first pipe connected with the tube for the fluid to circulate between the first pipe and the tube. The header pipe includes a second pipe on the first pipe. The header pipe includes a joint interconnecting the first and second pipes for the fluid to circulate between the first and second pipes through the joint.

The second pipe has an inlet and a stopper therein. The joint has holes located between the inlet and the stopper in communication with the first and second pipes. The holes become smaller in size as the joint extends toward the stopper.

The second pipe has an inlet and a stopper therein. The joint has holes located between the inlet and the stopper at pitches in communication with the first and second pipes. The pitches become greater as the joint extends toward the stopper.

The second pipe has an inlet and a stopper therein. The joint has holes located between the inlet and the stopper in communication with the first and second pipes. The joint has a regulation member between the holes.

BRIEF DESCRIPTION OF THE ACCOMPANYING DRAWINGS

DETAILED DESCRIPTION OF THE PREFERRED EMBODIMENTS

Figure 1:
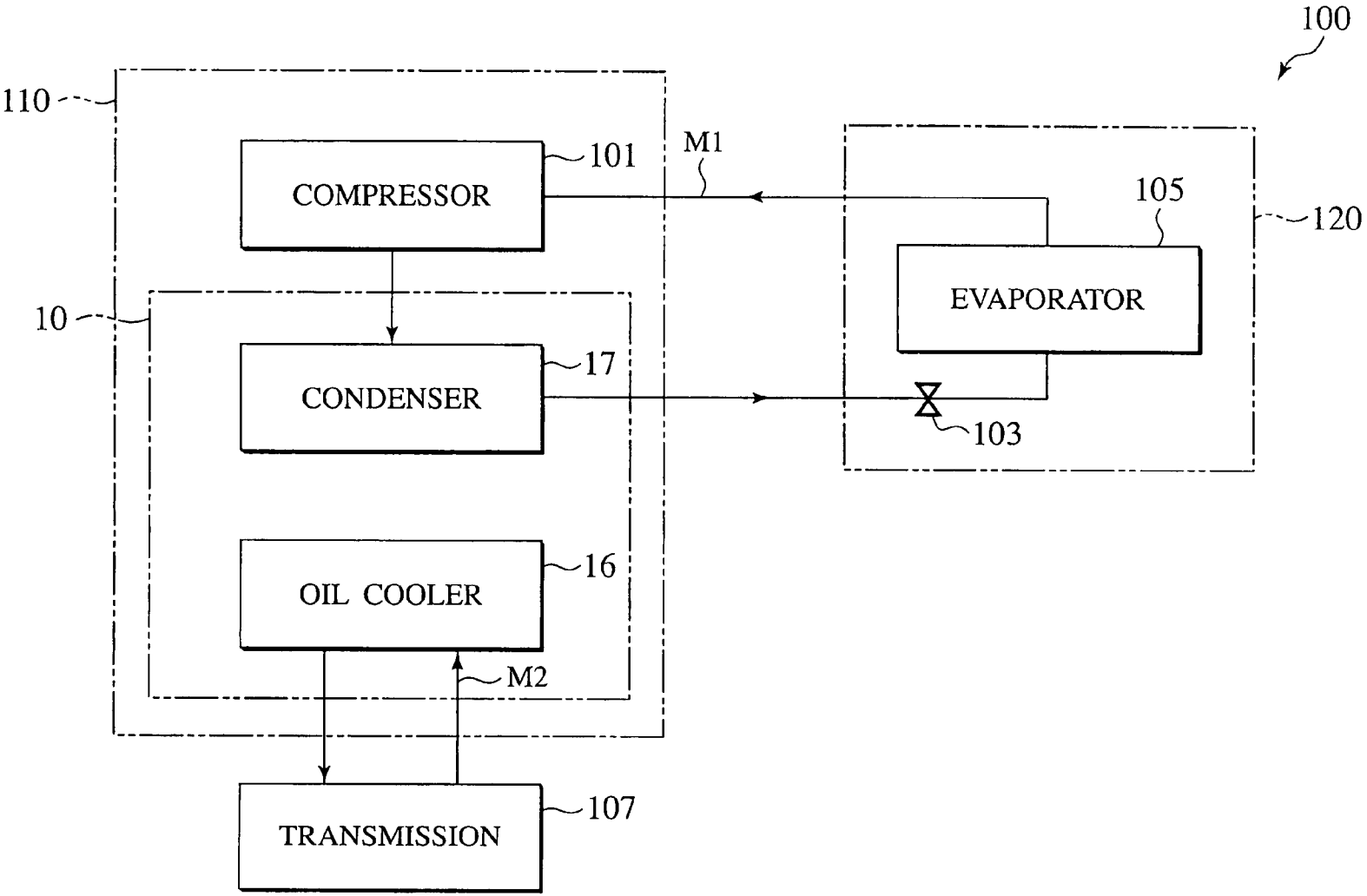
FIG. 1 is a block diagram showing an air-conditioning system.

Embodiments of the present invention will be described with reference to the accompanying drawings. Like members are designated with like reference numerals and the descriptions thereof are omitted.

First Embodiment

Referring to FIG. 1, a vehicle air-conditioning system 100 will be described.

The system 100 includes, as air conditioners, a compressor 101 and a condenser 17 in an engine room 110, and an expansion valve 103 and an evaporator 105 in a passenger compartment 120. Refrigerant absorbs heat from air in the passenger compartment 120, and is cooled by the condenser 17 with airflow during running.

The system 100 includes an oil cooler 16 in the engine room 110. The oil is heated to a high temperature in a transmission 107, and is cooled by airflow in the oil cooler 16 during running of a vehicle.

The oil cooler 16 and the condenser 17 are configured as one unit or a complex heat exchanger 10.

Figure 2A:
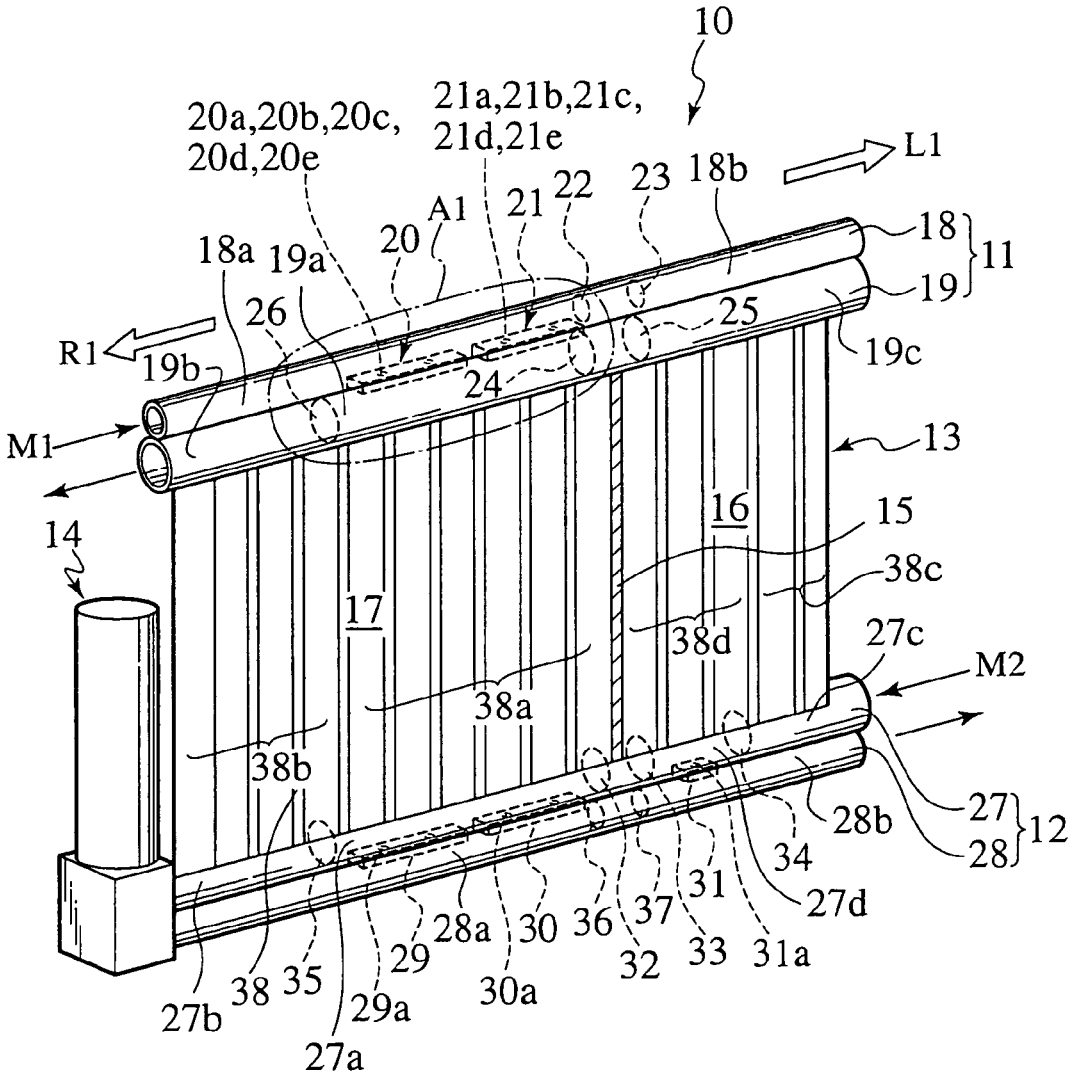
FIG. 2A is a perspective view showing a heat exchanger according to a first embodiment.

Referring to FIG. 2A, the heat exchanger 10 includes the oil cooler 16 as a first heat exchanger on the left side (L1 side in FIG. 2A) of a pseudo heat exchanging passage member 15. The heat exchanger 10 includes the condenser 17 as a second heat exchanger on the right side (R1 side in FIG. 2A) of the pseudo heat exchanging passage member 15. In FIG. 2A, a fin is omitted.

The condenser 17 cools refrigerant for an air conditioning cycle. The oil cooler 16 cools oil for an automatic transmission.

The heat exchanger 10 includes an upper header pipe 11 located at the upper and a lower header pipe 12 located at the lower. The heat exchanger 10 also includes a core 13 which interconnects the upper header pipe 11 and the lower header pipe 12 in the vertical direction. The heat exchanger 10 includes a liquid tank 14 connected to the side of the lower header pipe 12.

The upper header pipe 11 includes, as header pipe members, an upper pipe 18 and a lower pipe 19 in vertical contact with each other. The upper and lower pipes 18 and 19 are in communication with each other using joint members 20 and 21 having communication holes 20*a*, 20*b*, 20*c*, 20*d*, 20*e* and 21*a*, 21*b*, 21*c*, 21*d*, 21*e*.

The upper pipe 18 is closed off by two disk-shaped partitions 22 and 23 as stoppers. The partitions 22 and 23 are located at intermediate portion in the longitudinal direction. Partitions 22, 23, 24 and 25 are disposed at predetermined distances from one another. The partitions 24 and 26 have the joint members 20 and 21 therebetween.

The partitions 22 and 23 separate the upper pipe 18 into a pipe 18*a* for the condenser 17 and a pipe 18*b* for the oil cooler 16. The lower pipe 19 is also provided with the partitions 24 and 25 in positional coincidence with the partitions 22 and 23, and with a partition 26 in proximity to the liquid tank 14. The partitions 24 and 25 separated the lower pipe 19 into a pipe 19*a* to 19*b* for the condenser 17 and a pipe 19*c* for the oil cooler 16. The partition 26 separates the pipe 19*a* to 19*b* for the condenser into an inlet pipe 19*a* and an outlet pipe 19*b*.

Like the upper header pipe 11, the lower header pipe 12 includes an upper pipe 27 and a lower pipe 28 as adjacent header pipe members. The lower header pipe 12 includes joint members 29, 30 and 31 and partitions 32, 33, 34, 35 and 37, which allow the upper pipe 27 and the lower pipe 28 to communicate with each other. The joint members 29 to 31 include communication holes 29*a*, 30*a*, and 31*a*, respectively. The partitions 32 and 33 and the partition 36 and 37 are disposed at predetermined distances from one another. The partitions 32 and 33 separate the upper pipe 27 into a pipe 27*a* to 27*b* for the condenser 17 and a pipe 27*c* to 27*d* for the oil cooler 16. The partition 35 separates the pipe 27*a* to 27*b* for the condenser into an outlet pipe 27*a* and an inlet pipe 27*b*. The partition 34 divides the pipe 27*c* to 27*d* for the oil cooler into an inlet pipe 27*c* and an outlet pipe 27*d*.

The core 13 includes heat-exchange tubes 38 arranged side-by-side in the vertical direction. A refrigerant M1 for heat-exchange flows through the heat-exchange tubes 38*a* and 38*b*. An oil M2 flows through the heat-exchange tubes 38*c* and 38*d*. The core 13 includes corrugated fins (see FIG. 3) disposed between the adjacent heat exchanging tubes 38.

Figure 3:
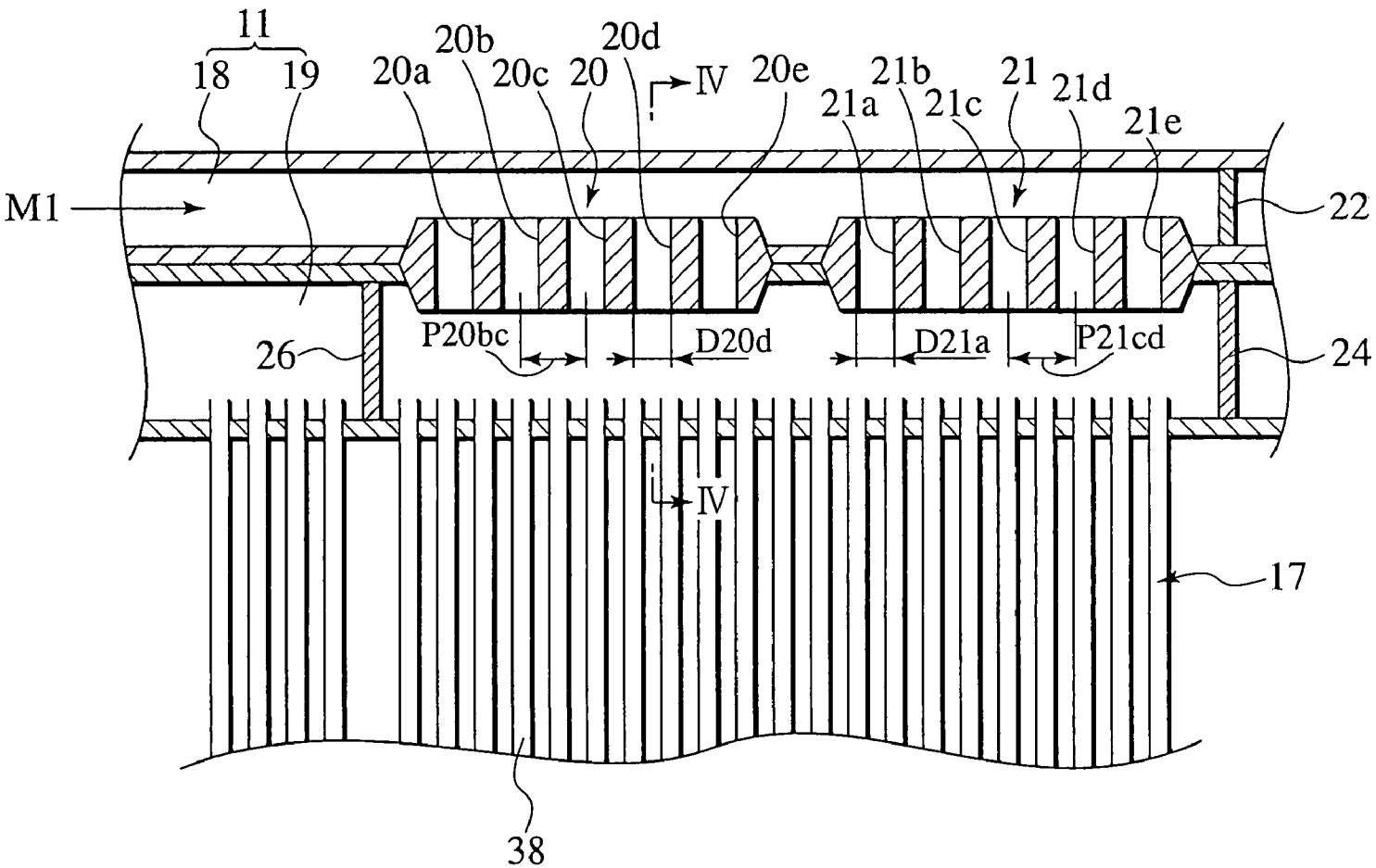
FIG. 3 is an enlarged longitudinal sectional view of a portion A1 in FIG. 2A.
Figure 4:
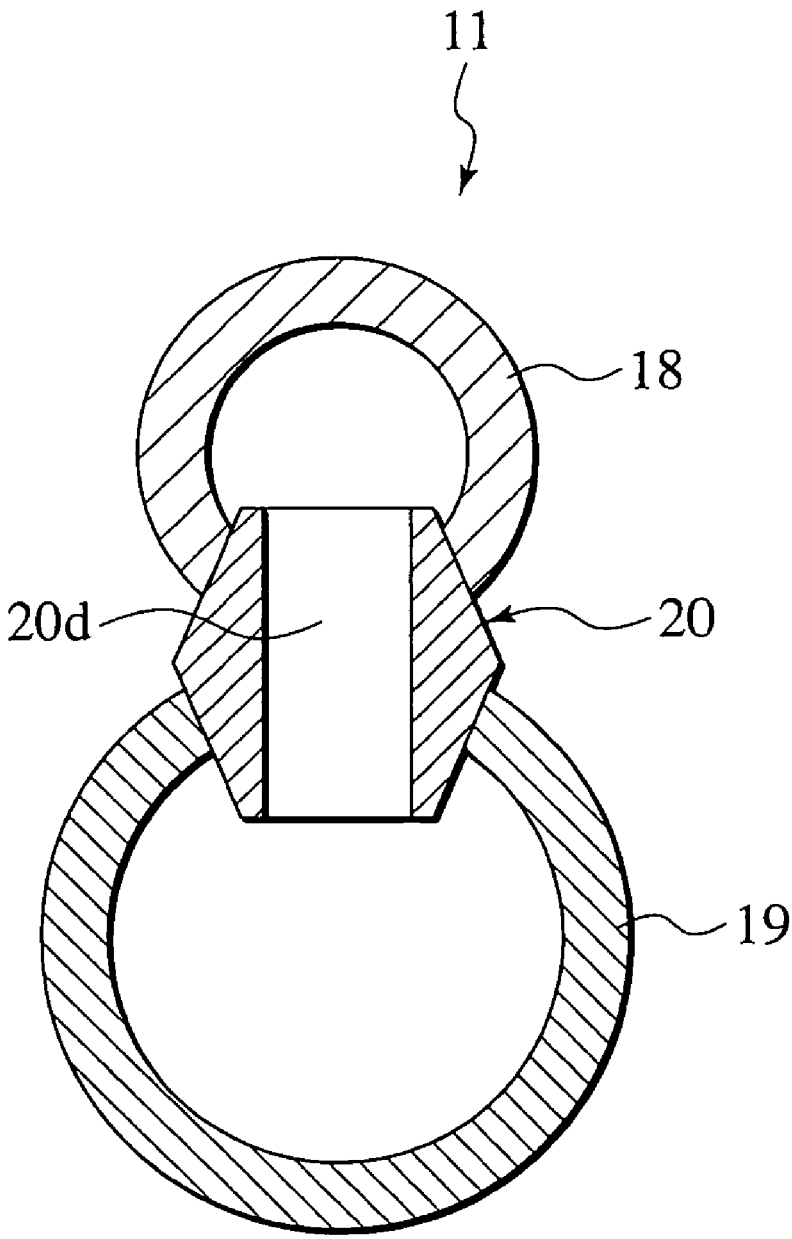
FIG. 4 is an enlarged cross sectional view taken along IV—IV in FIG. 3.
Figure 5:
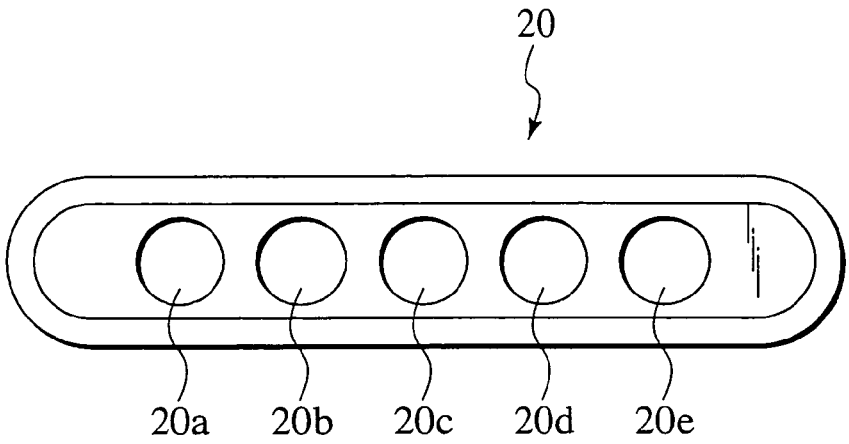
FIG. 5 is a plan view of a joint member shown in FIG. 3.
Figure 6:
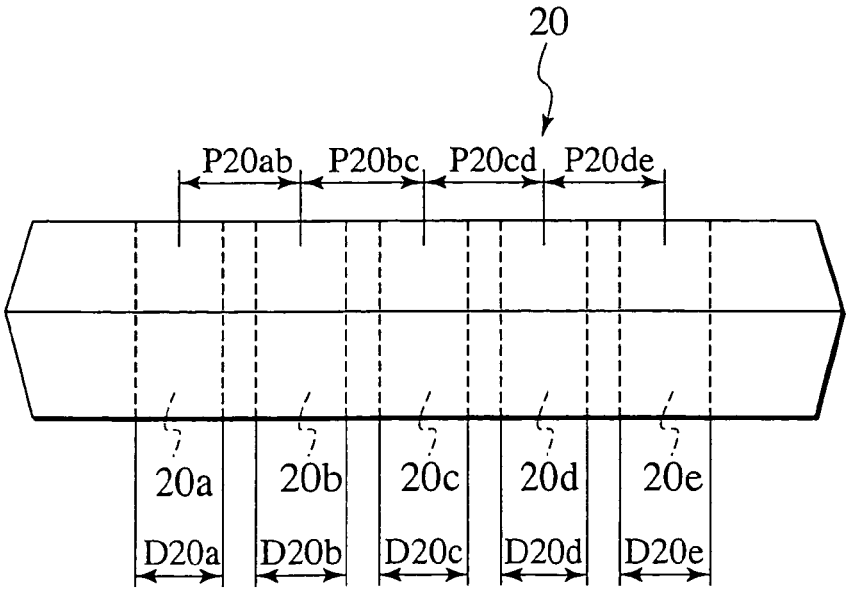
FIG. 6 is a side view of the joint member shown in FIG. 5.

Referring to FIG. 3, the lower portion of the upper pipe 18 and the upper portion of the lower pipe 19 are in communication with each other using the joint members 20 and 21. The joint members 20 and 21 are disposed between the partitions 24 and 26. The joint members 20 and 21 have the communication holes 20*a* to 20*e* and 21*a* to 21*e* which extend vertically threrethrough. As shown in FIGS. 5 and 6, the total of respective five communication holes 20*a* to 20*e* and 21*a* to 21*e* are disposed at constant distances from one another in the longitudinal direction of the joint members 20 and 21, i.e., along a flow direction of refrigerant M1 in the header pipe 11 shown in FIG. 3, respectively. More specifically, the communication holes 20*a* to 20*e* and 21*a* to 21*e* of the joint member 20 and 21 all have the identical hole diameters D20*a*, D20*b*, D20*c*, D20*d*, D21*e*, D21*a*, D21*b*, D21*c* D21*d* and D21*e* for the identical flow path areas. The communication holes 20*a* to 20*e* and 21*a* to 21*e* all have the identical hole pitches P20*ab*, P20*bc*, P20*cd*, P20*de*, P20*ef*, P21*ab*, P21*bc*, P21*cd* and P21*de* therebetween. The number of communication holes 20*a* to 20*e* or 21*a* to 21*e* is not limited to five, and the number can appropriately be changed in accordance with size and usage of the heat exchanger.

According to this embodiment, the heat exchanger 10 includes the upper pipe 18 and the lower pipe 19 as the header pipes 11 in communication with each other through the joint members 20 and 21. This greatly enhances the heat exchanger 10 in strength as compared with a heat exchanger having one header pipe. The single header pipe, vertically elongated in an elliptic or rectangular shape, is required to enlarge the thickness to maintain the destroy-pressure resistance strength. That is, the upper pipe 18 and the lower pipe 19 in communication with each other represents a function that the header pipe is vertically extended in view of the cross sectional shape. However, the two closed cross section is superior to the one closed cross section in terms of strength. Therefore, this structure maintains the destroy-pressure resistance strength with minimum material cost. When HFC 134*a* is used as the refrigerant M1, the destroy pressure-resistance strength as a maximum pressure is, for example, 9.91 Mpa, against which the heat exchanger safely bears. This embodiment sufficiently maintains this destroy pressure-resistance strength.

The operations of the vehicle air-conditioning system 100 and the heat exchanger 10 will be described as the following.

Referring to FIG. 1, the air-conditioning system 100 is used as the air conditioner. The refrigerant M1 is compressed by the compressor 101 to flow into the condenser 17. The refrigerant M1 is liquefied by the condenser 17, radiating heat. The refrigerant M1 is isenthalpic expanded by the expansion valve 103 to flow into the evaporator 104. The refrigerant M1 is evaporated in the evaporator 105, cooling air in the passenger compartment 120.

Next, the air-conditioning system 100 is used as an oil cooler. Oil M2 is heated by the transmission 106 to flow into the oil cooler 16. The oil M2 is cooled in the oil cooler 16.

Figure 2B:
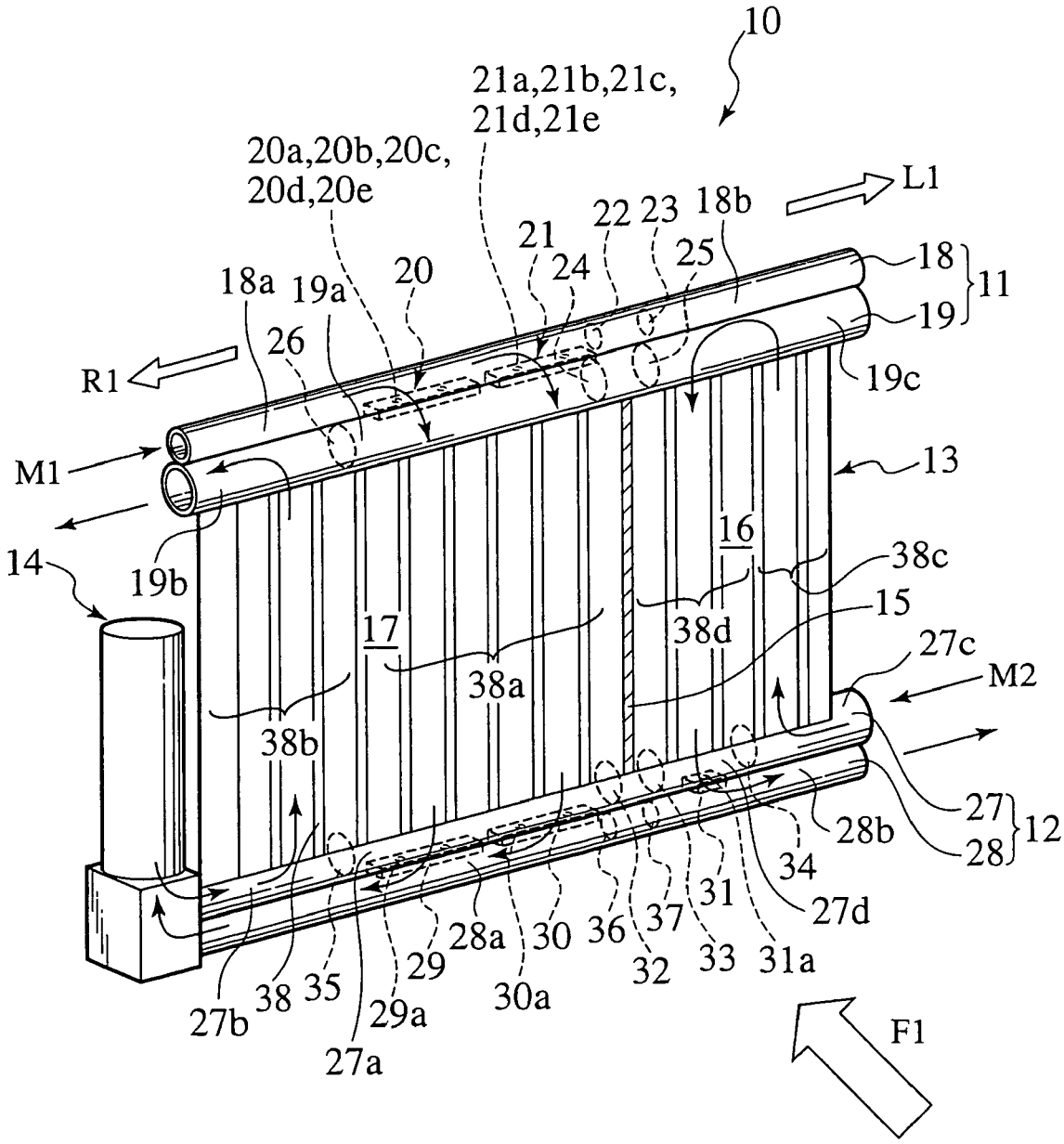
FIG. 2B is a perspective view showing the operation of the heat exchanger shown in FIG. 2A, wherein F1 indicates an airflow.

Referring to FIG. 2B, operations of the condenser 17 and the oil cooler 16 will be described.

The refrigerant M1 flows into the upper pipe 18*a* of the upper header pipe 11. The refrigerant M1 flows from the upper pipe 18 into the inlet pipe 19*a* through the communication holes 20*a* to 20*e* and 21*a* to 21*e*. The refrigerant M1 flows from the inlet pipe 19*a* into a first tube group 38*a*. The refrigerant M1 is liquefied in the first tube group 38*a* to flow into the outlet pipe 27*a*. At that time, the refrigerant M1 exchanges heat with airflow F1 through the first tube group 38*a* and is cooled.

The refrigerant M1 flows from the outlet pipe 27*a* into the lower pipe 28*a* through the communication holes 29*a* and 30*a* of the joint members 29 and 30. The refrigerant M1 flows from the lower pipe 28*a* into the inlet pipe 27*b* via the liquid tank 14. Excessive refrigerant is temporarily reserved in the liquid tank 14.

The refrigerant M1 flows from the inlet pipe 27*b* into a second tube group 38*b*, where the refrigerant M1 exchanges heat with the airflow F1 and is cooled. The refrigerant M1 flows from the second tube group 38*b* into the outlet pipe 19*b* and flows out toward the evaporator 105.

On the other hand, oil M2 flows from the inlet pipe 27*c* of the lower header pipe 12 into a third tube group 38*c*, where the oil M2 exchanges heat with the airflow F1 through the third tube group 38*c* and is cooled. The oil M2 flows from the third tube group 38*c* into a fourth tube group 38*d* via the lower pipe 19*c*, where the oil M2 is further cooled by the airflow F1. The oil M2 flows from the fourth tube group 38*d* into an outlet pipe 27*d*. The oil M2 flows from the outlet pipe 27*d* into the lower pipe 28*b* through the communication hole 31*a* of the joint member 31, and flows out toward the transmission 107.

Second Embodiment

Figure 7:
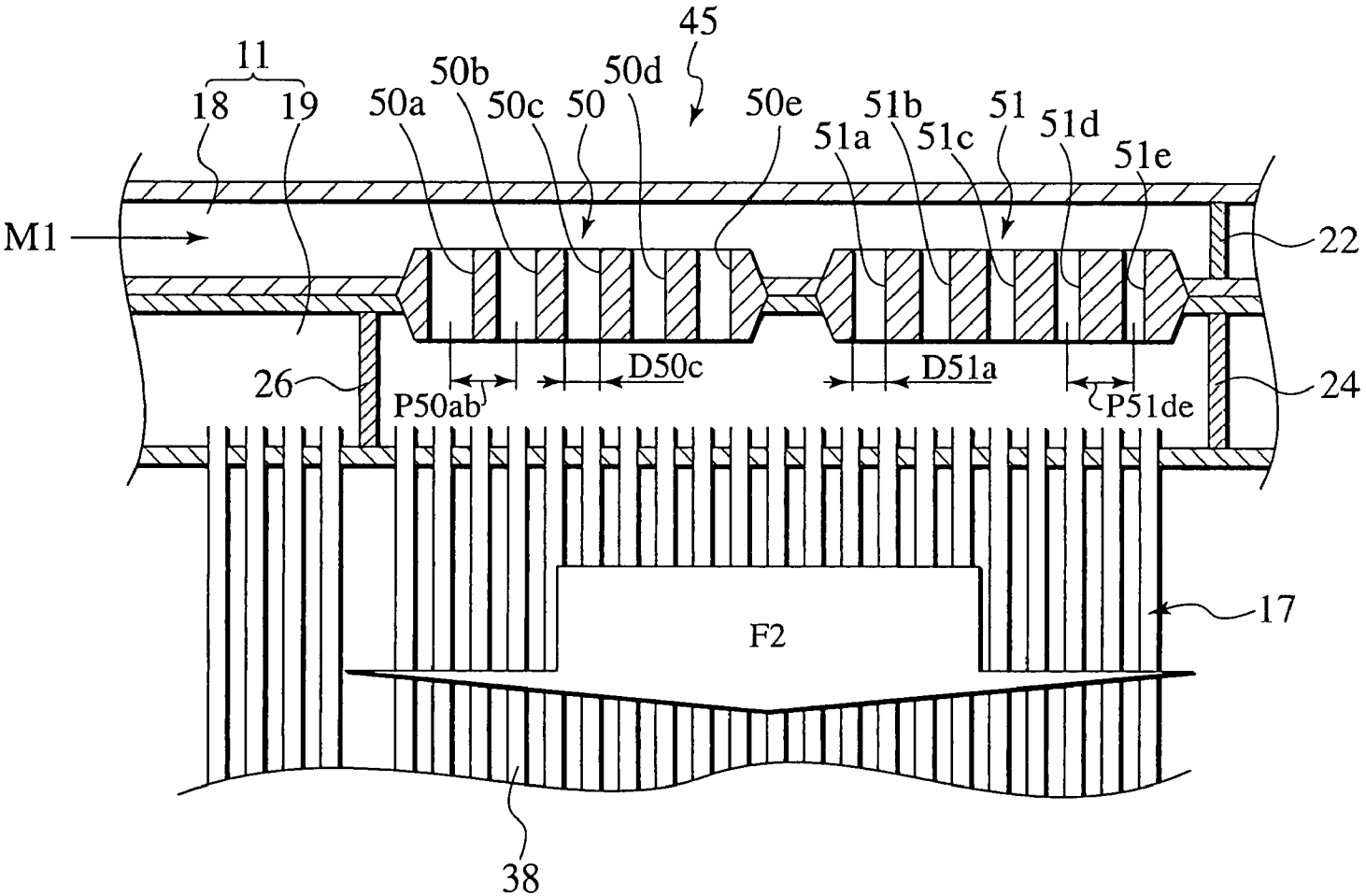
FIG. 7 is a vertical sectional view of a primary portion of a heat exchanger according to a second embodiment, wherein F2 indicates uniform separated flows.

Referring to FIG. 7, a heat exchanger 45 according to a second embodiment will be described.

Joint members 50 and 51 include communication holes 50*a* to 50*e* and 51*a* to 51*e* of hole diameters D50*a*, D50*b*, D50*c*, D 50*d*, D50*e* and D51*a*, D51*b*, D51*c*, D51*d*, D51*e* disposed along the header pipes 18 and 19 in the longitudinal direction. As the joint members 50 and 51 extend toward the downstream of the refrigerant M1 or toward the partition 22 in the longitudinal direction, the hole diameters D50*a* to D50*e* and D51*a* to D51*e* become gradually smaller. All the communication holes 50*a* to 50*e* and 51*a* to 51*e* have the identical hole pitches P50*ab*, P50*bc*, P50*cd*, P50*de*, P51*ab*, P51*bc*, P51*cd* and P51*de* set therebetween.

The joint member 50 is disposed upstream of the joint member 51 in the flowing direction of the refrigerant M1. Each of the joint members 50 and 51 includes five communication holes 50*a* to 50*e* or 51*a* to 51*e*. As the joint member 50 extends from the upstream (left side in FIG. 7) toward the downstream (right side in FIG. 7) in the flow of refrigerant M1, the hole diameter D50*a* to D 50*e* of the joint member 50 become gradually smaller. The hole pitches P50*ab* to P50*de* are constant over the entire communication holes 50*a* to 50*e*. As the joint member 51 extends from the upstream (left side in FIG. 7) toward the downstream (right side in FIG. 7) in the flow of the refrigerant M1, the hole diameter D51*a* to D51*e* of the joint member 51 become gradually smaller. The hole pitch P51*ab* to P51*de* are constant over the entire communication holes 51*a* to 51*e*. The hole diameter D51*a* of the most upstream communication hole 51*a* in the joint member 51 is smaller than the hole diameter D50*e* of the most downstream communication hole 50*e* in the joint member 50. That is, the hole diameters D50*a* to D50*e* and D51*a* to D51*e* become smaller, as communication holes 50*a* to 50*e* and 51*a* to 51*e* approach to the partition 22.

The cross section areas of the communication holes 50*a* to 50*e* and 51*a* to 51*e*, or the total of the flow path areas is the identical to that of the communication holes 20*a* to 20*e* and 21*a* to 21*e* in the first embodiment. From this relation, the flow rate of refrigerant M1 through the joint members 50 and 51 is the identical to that of the first embodiment.

According to the operation and benefit, the heat exchanger 45 enhances the in destroy pressure-resistance strength. The heat exchanger 45 allows refrigerant M1 to be uniformly distributed to the heat exchanging tubes 38, which realizes uniform separated flows F2.

As shown in FIG. 7, the upper pipe 18 is closed off by the partition 22 disposed upstream. The refrigerant M1 flows through the upper pipe 18 and flows into the lower pipe 19 through the communication holes 50*a* to 50*e* and 51*a* to 51*e* of the joint members 50 and 51. Here, the refrigerant M1 hits against the partition 22 and is stopped from flowing. Thus, the downstream refrigerant M1 becomes greater in dynamic pressure than upstream refrigerant M1, allowing the downstream refrigerant M1 to flow toward the lower pipe 19 faster than the upstream refrigerant M1. According to this embodiment, as the joint members 50 and 51 extend toward the downstream, the hole diameters D50*a* to D50*e* and D51*a* to D51*e* of the communication holes 50*a* to 50*e* and 51*a* to 51*e* become smaller. While, as the hole diameters D50*a* to D50*e* and D51*a* to D51*e* become smaller, the flow-path resistances become greater. Thus, the downstream communication holes 50*c* to 50*e* and 51*c* to 51*e* have flow-path resistance greater than the upstream communication holes 50*a*, 50*b*, 51*a* and 51*b*. From the above, the flow rates of the refrigerant M1, flowing from the upper pipe 18 to the lower pipe 19, become uniform over the header pipe 11 in the longitudinal direction. The result permits the refrigerant M1 to be uniformly distributed to the tubes 38*a* of the condenser 17.

Third Embodiment

Figure 8:
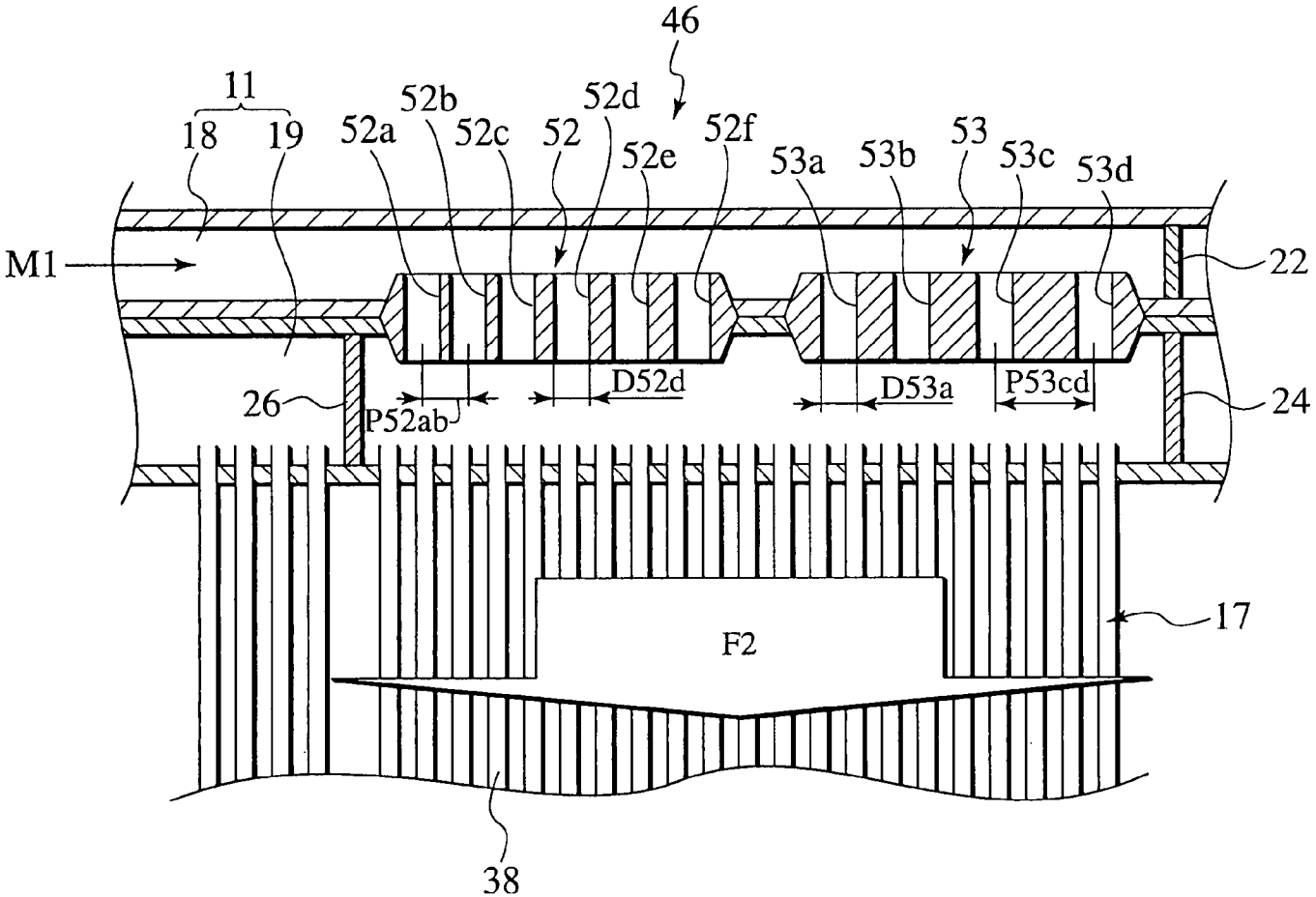
FIG. 8 is a vertical sectional view of a primary portion of a heat exchanger according to a third embodiment.

Referring to FIG. 8, a heat exchanger according to a third embodiment will be described.

The joint members 52 and 53 include communication holes 52*a* to 52*f* and 53*a* to 53*d* arranged at hole pitches P52*ab*, P52*bc*, P52*cd*, P52*de*, P52*ef*, P53*ab*, P53*bc*, and P53*cd*. The hole pitches P52*ab* to P52*ef* and P53*ab* to P53*cd* become gradually greater as the joint members 52 and 53 extend toward the downstream of the refrigerant M1 or the partition 22. The hole pitch P53*ab* to P53*cd* is set greater than the hole pitch P52*ab* to P52*ef*. All the communication holes 52*a* to 52*f* and 53*a* to 53*d* have the identical hole diameters D52*a*, D52*b*, D52*c*, D52*d*, D52*e*, D52*f*, D53*a*, D53*b*, D53*c* and D53*d*.

The joint member 52 is disposed upstream of the joint member 53 in the flow of the refrigerant M1. The joint members 52 and 53 have the six and four communication holes 52*a* and 53*a*, respectively. As the joint member 52 extends from the upstream side (left side in FIG. 8) toward the downstream side (right side in FIG. 8) in the flow of the refrigerant M1, the pitch P52*ab* to P52*ef* between the communication holes 52*a* to 52*f* gradually becomes greater. All the communication holes 52*a* to 52*f* have the identical hole diameters D52*a* to D52*f* or the identical flow path areas. As the joint member 53 extends from the upstream side (left side in FIG. 8) toward the downstream side (right side in FIG. 8) in the flow of the refrigerant M1, the pitch P53*ab* to P53*cd* between the communication holes 53*a* to 53*d* gradually becomes greater. All the communication holes 53*a* to 53*d* have the identical hole diameters D53*ab* to D53*cd* or the identical flow path areas. The minimum hole pitch P53*ab* between the most upstream communication holes 53*a* and 53*b* of the joint member 53 is greater than the maximum hole pitch P52*ef* between the most downstream communication holes 52*e* and 52*f*. That is, the pitches P53*aab* to P53*cd* become greater, the communication holes 52*a* to 53*d* approach to the partition 22. The cross section areas of the communication holes 52*a* to 52*f* and 53*a* to 53*d* or the total of the flow path areas is the identical to that of the communication holes 20*a* to 20*e* and 21*a* to 21*e* in the first embodiment. From this relation, the flow rate of refrigerant M1, passing through the joint members 52 and 53, is the identical to that of the first embodiment.

According to the operation and benefit, the heat exchanger 46 enhances the destroy pressure-resistance strength, and allows the refrigerant M1 to be uniformly distributed to the heat exchanging tubes 38.

As shown in FIG. 8, the hole pitches P52*ab* to P52*ef* and P53*ab* to P53*cd* between the communication holes 52*a* to 52*f* and 53*a* to 53*d* become greater as the joint members 52 and 53 extend toward the downstream or partition 22. The hole pitches P53*ab* to P53*cd* are greater than the hole pitches P52*ab* to P52*ef*. As the refrigerant M1 flows downstream toward the partition 22 in the upper pipe 18, the dynamic pressures become larger. While, the downstream communication holes 52*d* to 52*f* and 53*c* and 53*d* have flow path resistance identical to the upstream communication holes 52*a*, 52*b*, 53*a* and 53*b*. From the above, the flow rates of the refrigerant M1, flowing from the upper pipe 18 to the lower pipe 19, become uniform over the header pipe 11 in the longitudinal direction. The result allows the refrigerant M1 to be uniformly distributed to the tubes 38 of the condenser 17.

Fourth Embodiment

Figure 9:
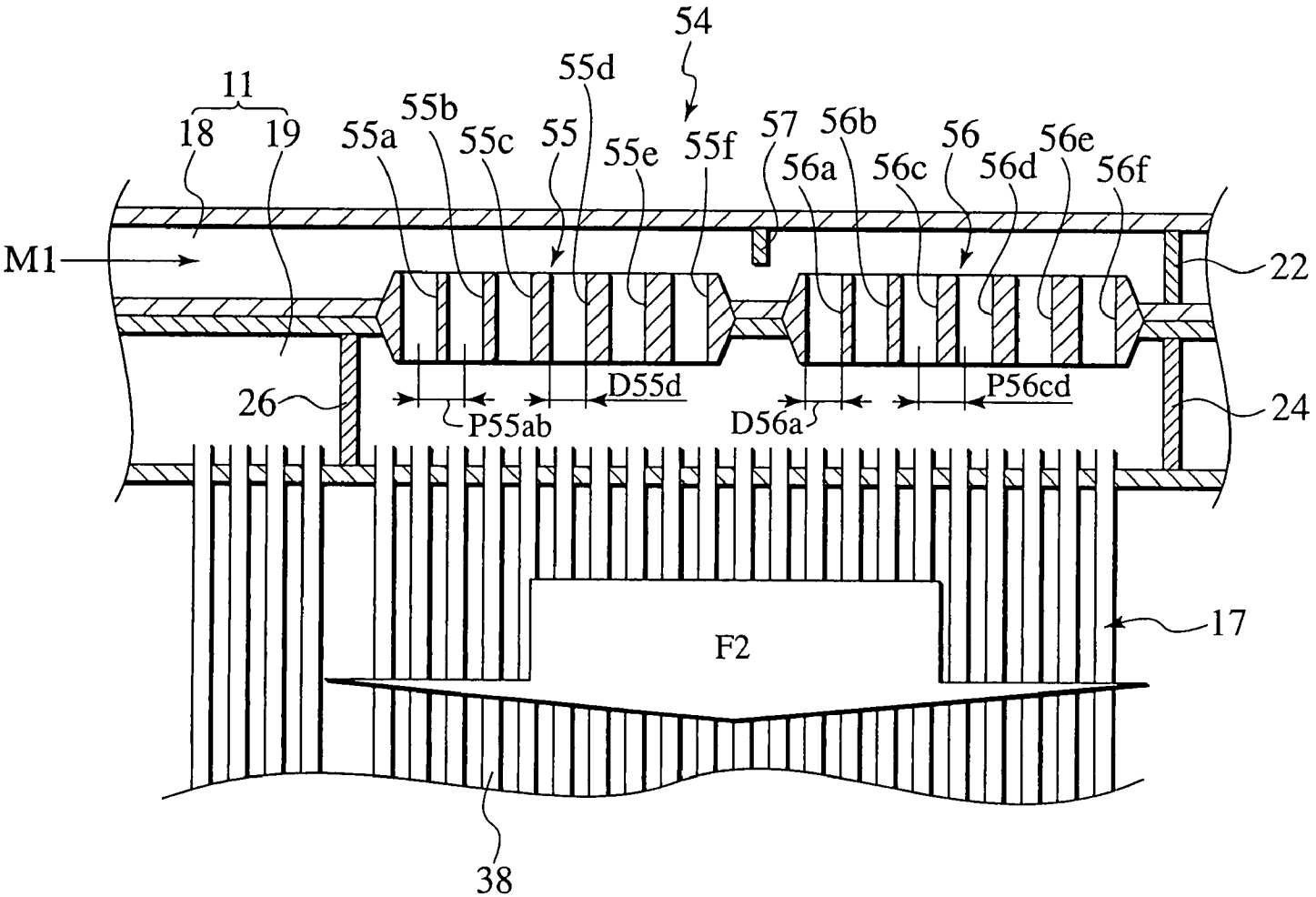
FIG. 9 is a longitudinal sectional view of a primary portion of a heat exchanger according to a fourth embodiment.

Referring to FIG. 9, a heat exchanger according to a fourth embodiment will be described.

This embodiment has joint members 55 and 56 having identical configurations. The joint members 55 and 56 are arranged in series along a flow direction of the refrigerant M1 in the header pipe 11 or longitudinal direction of the header pipe 11. The joint members 55 and 56 have a regulating plate 57 located therebetween. The regulating plate 57 is fixed to the upper portion of the inner peripheral surface of the upper pipe 18. The regulating plate 57 is of substantially semi-circular shape as viewed from front. The regulating plate 57 extends downward in a direction (radial direction of the upper pipe 18) perpendicular to the flowing direction of the refrigerant M1.

The joint member 55 includes communication holes 55*a* to 55*f*. As the joint member 55 extends toward the downstream of the refrigerant M1 or the partition 22, the hole pitches P55*ab*, P55*bc*, P55*cd*, P55*de* and P55*ef* between the communication holes 55*a* to 55*f* gradually becomes greater. All the communication holes 55*a* to 55*f* has the identical hole diameters D55*a*, D55*b*, D55*c*, D55*d*, D55*e* and D55*f*. The joint member 56 includes communication holes 56*a* to 56*f* at hole pitches P56*ab*, P56*bc*, P56*cd*, P56*de* and P56*ef*. The hole pitches P56*ab* to P56*ef* between the communication holes 56*a* to 56*f* gradually become greater, as the joint member 56 extends toward the downstream of the refrigerant M1 or the partition 22. All the communication holes 56*a* to 56*f* have the identical hole diameters D56*a*, D56*b*, D56*c*, D56*d*, D56*e* and D56*f*. The joint members 55 and 56 have respective identical hole diameters D55*a* to D56*f* and D56*a* to D56*f* and respective identical hole pitches P55*ab* to P56*ef* and P56*ab* to P56*ef* for the identical configuration. The cross section areas of the communication holes 55*a* to 55*f* and 56*a* to 56*f* or the total of the flow path areas is identical to that of the communication holes 20*a* to 20*e* and 21*a* to 21*e* in the first embodiment. The flow rate of the refrigerant M1, flowing through the joint members 55 and 56, is identical to that of the first embodiment. The regulating plate 57 appropriately controls the flowing direction and the flow rate of the refrigerant M1. The regulating plate 57 is disposed between the joint members 55 and 56 to stop a portion of the flow of the refrigerant M1 in front of the joint member 56, reducing the flow velocity thereof.

According to the embodiment, the heat exchanger 54 includes the regulating plate 57 disposed between the joint members 55 and 56. The regulating plate 57 stops a portion of the flow of the refrigerant M1 in front of the joint member 56, and reduces the flow velocity thereof. This structure allows the dynamic pressure of the refrigerant M1 to be applied longitudinally to the joint members 55 and 56 in equal profile. That is, as the joint member 55 or 56 extends toward partition 22, the dynamic pressure becomes greater. While, the joint members 55 and 56 have the communication holes 55*a* to 55*f* and 56*a* to 56*f* having respective identical hole diameters D55*a* to D55*f* and D56*a* to D56*f* and respective identical hole pitches P55*ab* to P55*ef* and P56*ab* to P56*ef*. This structure allows the refrigerant M1 to be uniformly distributed to the heat exchanging tubes 38. The joint members 55 and 56 with identical configurations reduce the productive cost.

The heat exchanger of this invention is not limited to the above-described embodiments, and can variously be changed and modified.

For example, in the above embodiments, the joint members 20, 21, 50, 51, 52, 53, 55, 56 have the communication holes 20*a* to 20*e*, 21*a* to 21*e*, 50*a* to 50*e*, 51*a* to 51*e*, 52*a* to 52*f*, 53*a* to 53*d*, 55*a* to 55*f* and 56*a* to 56*f* having hole diameters and hole pitches, which may are appropriately changed, allowing the refrigerant M1 to be equally distributed to the heat exchanging tubes 38. The reducing of the amount of the downstream separated flows may reduce the influence of heat on the condenser 17 from the oil cooler 16.

The core 13 includes the high temperature side oil cooler 16 and the low temperature side condenser 17. With this configuration, heat from the oil cooler 16 is prone to influence a portion of the heat exchanging tubes 38 as the condenser 17 in proximity to the oil cooler 16. If the heat is transferred from the oil cooler 16 to the condenser 17, the heat-exchange performance of the entire heat exchanger is possibly deteriorated. On the other hand, if the amount of separated flows of the refrigerant M1 in the condenser 17 in proximity to the oil cooler 16 is restricted, the condenser 17 does not have heat influence of the oil cooler 16, maintaining high heat-exchange performance.

The fourth embodiment has the regulating plate 57 that stops a portion of the refrigerant M1 from flowing in front of the joint member 56. Alternatively, a regulating plate may have such a shape that allows a flowing direction of the refrigerant M1 to be changed.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

According to the invention, header pipe members communicate with each other through a joint member having communication holes, thus enhancing a header pipe in strength. Here, a heat exchanger with one header pipe is required to enlarge thickness for maintaining pressure-resistance (destroy-pressure resistance). While, the invention has the header pipe of the header pipe members, and the header pipe members communicate with each other through the joint member. This structure reduces pressure receiving size of respective header pipes, ensuring pressure-resistance with small thickness, maintaining pressure-resistance with minimum material cost.

The communication holes have hole sizes greater at upstream side of the medium. The hole sizes become smaller as the communication holes approach to downstream side of the medium. This allows downstream communication holes to have greater flow-path resistance than upstream communication holes. This structure allows flow rate of medium from one header pipe member to the other header pipe member to be uniform over the joint member in the longitudinal direction. The result permits medium to be uniformly distributed from the other header pipe member to a heat-exchange tube.

The communication holes has hole pitches therebetween, which become greater as the communication holes approach to downstream side. The downstream hole pitches have greater flow-path resistance than the upstream hole pitches. This structure allows flow rate of medium from one header pipe member to the other header pipe member to be uniform over the joint member in the longitudinal direction. The result permits medium to be uniformly distributed from the other header pipe member to a heat-exchange tube.

A header pipe has joint members therein, which have a regulating member therebetween configured to regulate flow of medium. This structure appropriately regulates flow of the medium relative to the header pipe member at downstream side. This allows the joint members to have identical structures.

What is claimed is:

1. A heat exchanger comprising:

a core including heat-exchange tubes for a heat exchange medium to circulate therein and fins joined to the heat-exchange tubes; and inlet and outlet headers connected to the core, wherein each of the headers includes a first header pipe connected to the heat-exchange tubes;

a second header pipe arranged parallel with the first header pipe; and a joint member joining the first and second header pipes and having a plurality of communication holes connecting the first and second header pipes, wherein the holes are arranged in a longitudinal direction of the header pipes at intervals.

2. The heat exchanger of claim 1, wherein the communication holes have hole sizes greater at an upstream side of a flow of the heat-exchange medium in the first and second header pipes, and wherein the hole sizes are smaller, as the communication holes are closer to a downstream side of the heat exchange medium.

3. The heat exchanger of claim 1, wherein the communication holes have hole pitches therebetween smaller at an upstream side of a flow of the heat-exchange medium flowing in the first and second header pipes, and wherein the hole pitches are greater, as the communication holes are closer to a downstream side of the heat exchange medium.

4. The heat exchanger of claim 1, wherein the joint member in the inlet header includes a first joint member and a second joint member; and wherein the first joint member and the second joint member have a regulation member therebetween configured to regulate the heat exchange medium.

5. A heat exchanger comprising:

tubes having a fluid therein for exchanging heat between the fluid and airflow during running of a vehicle; and a pair of headers connected to the tubes, each of the headers having a first pipe connected to the tubes a second pipe arranged parallel with the first pipe; and a joint joining the first and second pipes and having a plurality of communication holes arranged in a longitudinal direction of the headers at intervals.

6. The heat exchanger of claim 5, wherein the second pipe has an inlet and a stopper therein, wherein the holes are located between the inlet and the stopper, and wherein the holes are smaller in size as the joint extends toward the stopper.

7. The heat exchanger of claim 5, wherein the second pipe has an inlet and a stopper therein, wherein the holes are located between the inlet and the stopper at pitches, and wherein the pitches become greater as the joint extends toward the stopper.

8. The heat exchanger of claim 5, wherein the second pipe has an inlet and a stopper therein, wherein the holes are located between the inlet and the stopper, and wherein the second pipe has a regulation member between two of the holes.

* * * * *